US008011153B2

(12) United States Patent
Orchard

(10) Patent No.: US 8,011,153 B2
(45) Date of Patent: Sep. 6, 2011

(54) DECK FASTENER AND METHOD OF USE

(76) Inventor: Brian Keith Orchard, London (CA)

( * ) Notice: Subject to any disclaimer, the term of this patent is extended or adjusted under 35 U.S.C. 154(b) by 25 days.

(21) Appl. No.: 12/379,126

(22) Filed: Feb. 13, 2009

(65) Prior Publication Data

US 2010/0205895 A1 Aug. 19, 2010

(51) Int. Cl.
*E04F 15/04* (2006.01)
*E04B 5/00* (2006.01)
*E04B 1/38* (2006.01)

(52) U.S. Cl. ..... 52/489.1; 52/715; 52/512; 24/329; 24/295

(58) Field of Classification Search ..... 52/489.1, 52/512, 715; 24/329, 545, 293–295
See application file for complete search history.

(56) References Cited

U.S. PATENT DOCUMENTS

| | | | | | |
|---|---|---|---|---|---|
| 876,399 | A * | 1/1908 | Robinson | 52/714 |
| 1,246,585 | A * | 11/1917 | Geraerdts | 52/715 |
| 1,661,251 | A * | 3/1928 | Frey | 52/489.1 |
| 1,714,738 | A * | 5/1929 | Smith | 52/512 |
| 1,888,611 | A * | 11/1932 | Wolfson | 52/512 |
| 1,889,138 | A * | 11/1932 | Wolfson | 52/512 |
| 1,898,364 | A * | 2/1933 | Gynn | 52/512 |
| 1,905,616 | A * | 4/1933 | Zanella | 52/715 |
| 2,038,433 | A * | 4/1936 | Lawrence, Jr. | 52/512 |
| 2,116,737 | A * | 5/1938 | Urbain | 52/489.2 |
| 2,807,063 | A * | 9/1957 | Berow | 52/715 |
| 3,144,733 | A * | 8/1964 | Balinski | 52/714 |
| 3,181,662 | A * | 5/1965 | Maertzig, Jr. | 52/509 |
| 3,331,180 | A * | 7/1967 | Vissing et al. | 52/714 |
| 3,398,982 | A * | 8/1968 | Venzie, Jr. | 52/714 |
| 3,412,515 | A * | 11/1968 | Finon | 52/480 |
| 3,553,919 | A * | 1/1971 | Frey | 52/506.1 |
| 4,170,859 | A * | 10/1979 | Counihan | 52/779 |
| 4,516,373 | A * | 5/1985 | Osawa | 52/387 |
| 4,599,842 | A * | 7/1986 | Counihan | 52/586.2 |
| 4,620,403 | A * | 11/1986 | Field | 52/480 |
| 4,703,603 | A * | 11/1987 | Hills | 52/582.1 |
| 5,502,942 | A * | 4/1996 | Gras et al. | 52/511 |
| 5,653,079 | A * | 8/1997 | Loeffler et al. | 52/712 |
| 6,314,699 | B1 * | 11/2001 | West | 52/489.1 |
| 6,490,838 | B2 * | 12/2002 | Summerford | 52/650.3 |
| 6,540,432 | B2 * | 4/2003 | Albanese | 403/388 |
| 6,711,864 | B2 * | 3/2004 | Erwin | 52/582.1 |
| 7,386,959 | B2 * | 6/2008 | Ouellette | 52/204.53 |
| 7,398,623 | B2 * | 7/2008 | Martel et al. | 52/489.2 |
| 7,546,717 | B2 * | 6/2009 | Juan Puerta | 52/586.1 |
| 7,596,911 | B2 * | 10/2009 | Turco | 52/127.6 |
| 7,614,197 | B2 * | 11/2009 | Nelson | 52/582.1 |
| 7,757,365 | B2 * | 7/2010 | Ouellette | 29/410 |
| 2001/0015042 | A1 * | 8/2001 | Ballard | 52/589.1 |
| 2003/0121226 | A1 * | 7/2003 | Bolduc | 52/391 |

* cited by examiner

*Primary Examiner* — Robert Canfield

(57) ABSTRACT

A clip device for fastening first and second structural members typically decking members. The clip device has a base portion with first and second opposed ends and a thickness a first vertical leg portion integral with the leg base portion is horizontally spaced apart from a second vertical leg portion integral with the base portion. Arm flange portions integral to the first and second vertical leg portions are horizontally spaced from the base and aligned respectively towards said first and second opposed ends. A fastener receiving hole in the base is used to attach the clip device to the joist. The base portion, vertical leg portion and arm flange portion define diametrically opposed U-shaped jaw elements for holding the structural member to the joist.

6 Claims, 5 Drawing Sheets

DECK FASTENER AND METHOD OF USE

TECHNICAL FIELD

The invention relates to an under deck fastening system and method, in addition, to a deck fastener clip which can be used to "invisibly" attach a deck board to a supporting joist-like structure.

BACKGROUND OF THE ART

There are a variety of decking systems on the market today. Most of the decking systems utilize some sort of fastening means such as a screw, nail or staple to attach the decking members to the underlying joists. Furthermore, with most decking systems, the fastening means is installed directly through the top face of the decking members to the joist below. However, these decking systems have some major drawbacks.

The common method of securing the decking members to the underlying joists by directly fastening the decking member to the joist through the top face of the decking member has many drawbacks. First, the fastening means are visible and this leads to many shortcomings. The heads of the fastening means are unattractive and take away from the facade of the natural or synthetic wood, the fastening means may rust and discolor the decking members, the fastening means may work loose and become a safety hazard to persons walking on top of the decking structure, finally hammer blows to decking surface during installation may damage the surface of the decking member.

Another problem with this common method is that installation may become problematic because one cannot see exactly where the joists lie underneath the decking member. Therefore, numerous times during installation of the decking members, the person installing the deck may miss a joist or only partially strike a joist and have to back out the fastening means or leave the fastening means in the decking member and install yet another fastening means to secure the decking member to the joist. Once again, this problems leads to the aforementioned problems with visible fastening means.

Another shortcoming of the most common method of deck installation is that after a period time the decking members may loosen and move. The movement of the decking members causes problems. First, the decking does not keep its uniform look, which results in loss of aesthetic appeal. In addition, the decking members may move enough to cause the loss of the sought after gaps between the installed decking members. If the gaps between the decking members disappear, there is nowhere for rainwater or other liquids to drain from the decking structure.

The current deck systems that use plates have some major drawbacks. First, with most deck systems that use plates, the fasteners are secured upwards from underneath the decking member. This makes installation and maintenance troublesome because the person installing or maintaining the deck must work from underneath the deck. This situation is especially troublesome with decking that is situated close to the ground and is hard to reach from underneath the decking members.

SUMMARY OF THE INVENTION

An object of the invention is that the decking members are easy to install. This is especially true with regards to decks that are situated close to the ground and have limited access to the underside of the decking members. With this system, there is no need to access the underside of the decking members for installation or maintenance. With this system there is no requirement to use any fastening means that penetrate any surface of the decking member.

Accordingly, an object the invention is to provide a decking installation system, method and clip with a cost effective means of manufacture. This is accomplished because the system mainly requires one style of clip for fastening. Therefore, it is very cost effective to manufacture the decking installation system. Furthermore, the system is hidden because no part of the fasteners is seen from the decking surface.

Additionally, the invention facilitates straightforward installation and maintenance because the embodiments position and maintain the proper spacing among the decking members and between the decking member and the joist. This eliminates the need to use spacers during installation. Moreover, the person installing or maintaining the decking members will not have to use a hammer to strike any part of the decking members.

Since the proper spacing of the decking members is maintained at all times, the invention promotes appropriate aeration around the decking members. The proper spacing that promotes appropriate aeration is maintained between both the multiple decking members and between the decking members and the joists. Appropriate aeration helps maintain low levels of mold and fungus growth on the decking members.

Last, the exemplary embodiments do not produce indentations or impressions on the surface of the decking boards during installation or maintenance. There is no need to hammer down fastening devices on any surface of the decking boards because the fastening devices are hidden. The lack or indentations or impressions results in a reduction of discoloration of the decking members, or splintering of the decking members.

BRIEF DESCRIPTION OF THE DRAWINGS

In order that the invention may be more clearly understood, embodiments thereof will now be described in detail by way of example, with reference to the accompanying drawings, in which identical parts are identified by identical part numbers and in which.

DESCRIPTION OF PREFERRED EMBODIMENTS

Figure 1:
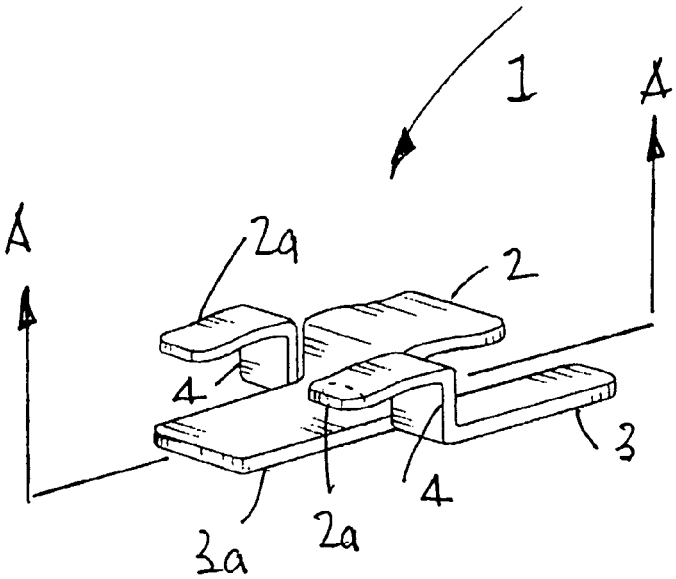
FIG. 1 is a perspective view of the clip according to this invention.
Figure 5:
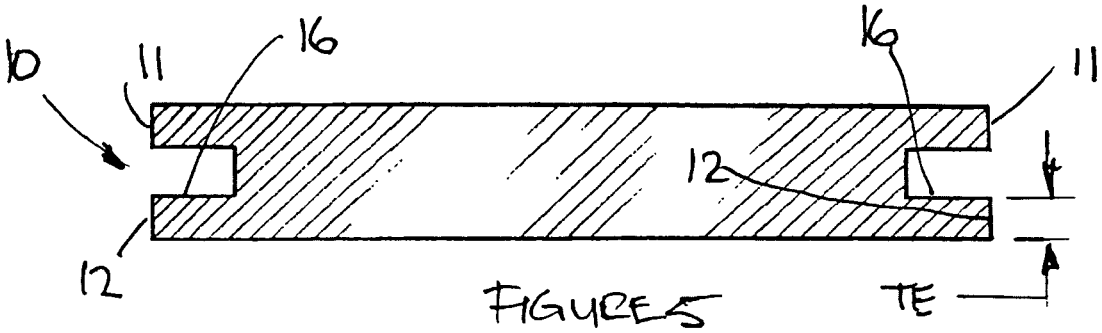
FIG. 5 is a cross sectional view of a deck member

Referring to FIG. 1, a unitary clip 1 according to this invention is illustrated. The clip is intended to be used in conjunction with a deck member or plank which is manufactured with longitudinal grooves or slots 10 in each opposing end as shown in FIG. 5. In use, the clip is securely fastened to the surface of a supporting deck surface such as a joist member and serves as an anchoring device to secure the decking members.

The grooves 10 function to receive the clip. Referring to FIG. 5, the groove or slot 10 in the side edge of the decking member forms a top edge 11 and a bottom edge 12. The thickness of the bottom edge TE of the decking member is sized to be slightly larger than the arm flange height h of the clip shown in FIG. 4 as will be hereafter described. This method of installing decking members is especially useful for more expensive decking members manufactured from non-wood, PVC or composite materials. Traditional wood decking members may also be used.

Figure 2:
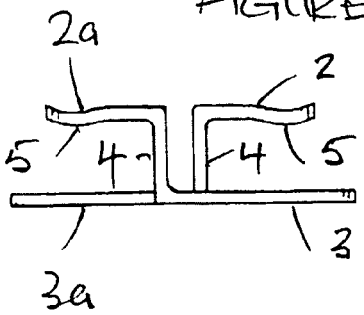
FIG. 2 is a cross sectional view of the clip taken along A-A of FIG. 1.
Figure 4:
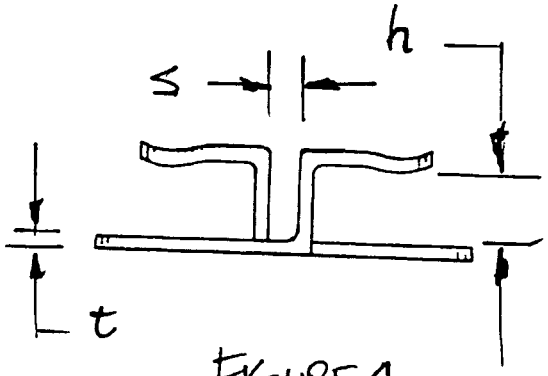
FIG. 4 is the same view as FIG. 2

Referring to FIGS. 1, 2 and 4, the unitary clip 1 has diametrically opposed arm flanges 2 and 2*a* which are respectively connected to a pair of diametrically opposed base portions 3 and 3*a* by means of vertical legs 4 thereby forming diametrically opposed U-shaped jaws on either side of the clip to engage the bottom edge 12 of the deck member as will be hereinafter described. The base portions 3 and 3*a* have a uniform thickness t which functions to elevate the deck board above the supporting joist 13 as shown in black shade at 11 in FIG. 6 to provide for air circulation. The vertical legs 4 for each opposing arm flange are horizontally spaced from one another a distance S as shown in FIG. 4 to provide for uniform spacing between the deck members when installed.

The arm flanges are elevated a distance h above the base portion. When the clip is securely attached to a joist member, the outer ends of the arm flanges are preferably biased against upward movement. The mid portion of the arm flanges are curved or indented 5 downwardly to define the vertical distance h of the arm flanges above the base portions at that point. The distance h is selected to be slightly smaller by about 0.05 inches than the thickness TE of the bottom edge of the deck member. By way of example, when a deck member is inserted into the clip (or vice versa), the arm flanges are displaced upwardly as a consequence and correspondingly exert a downward force on the bottom surface 16 of the groove to thereby hold it securely in place. Although the clip may come in different sizes, the height of the arm flanges h must be in each case selected to be slightly less than the height TE of the bottom edge 12 of the deck member to thereby ensure deck member is held firmly in place.

Figure 7:
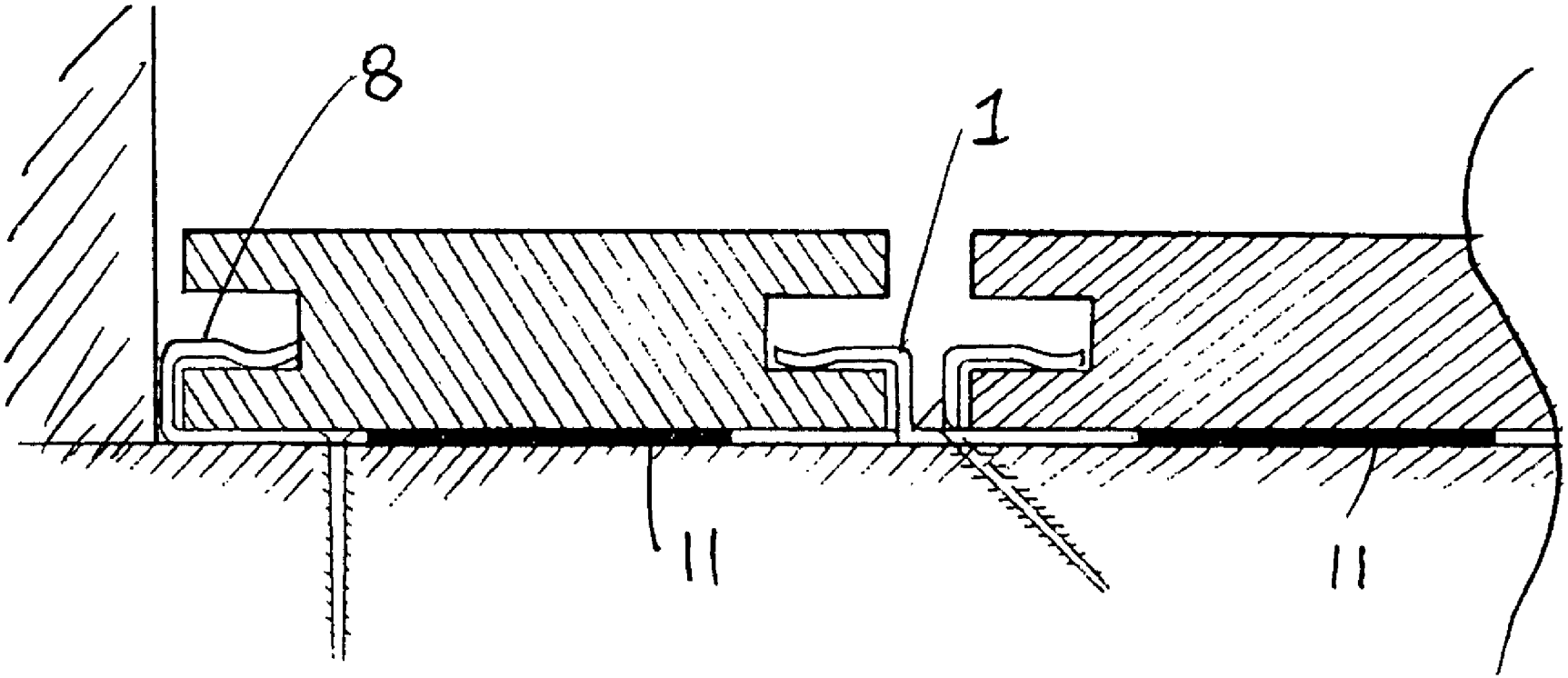
FIG. 7 is a cross sectional view of two deck members and clip at another stage of assembly
Figure 8:
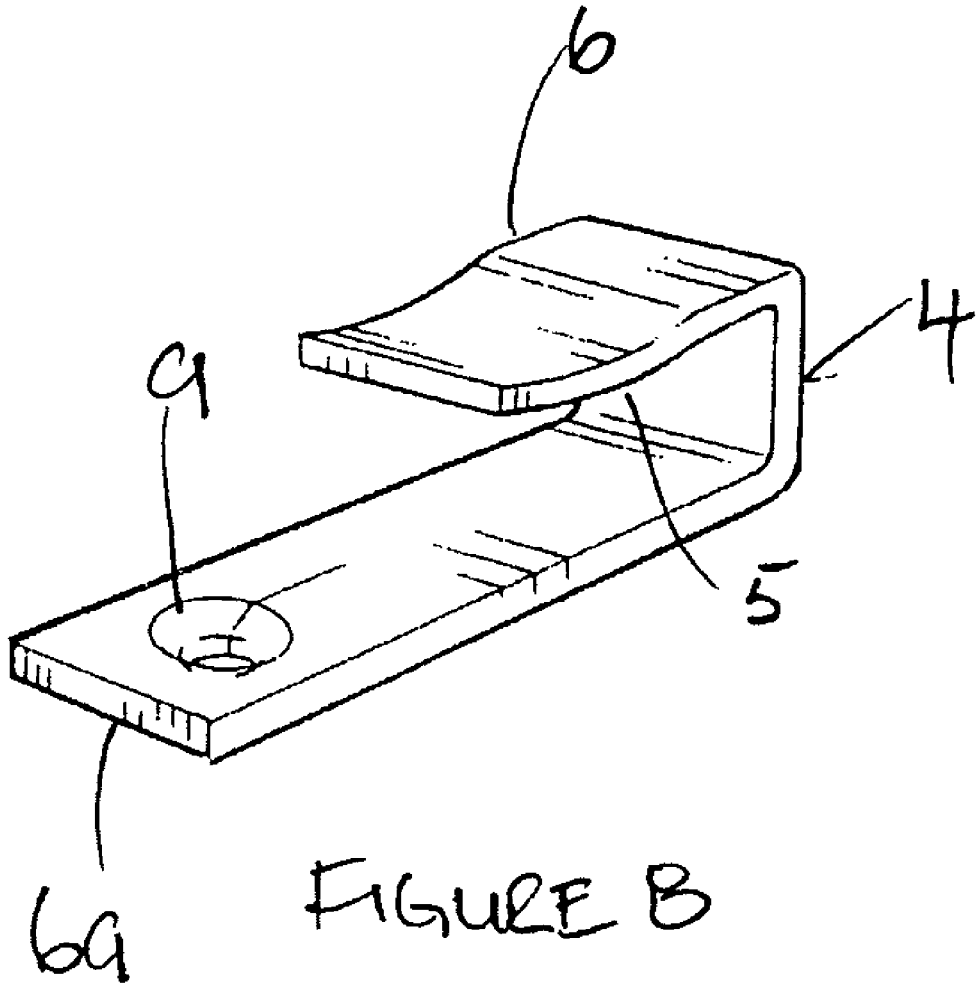
FIG. 8 is a perspective view of a starter clip
Figure 9:
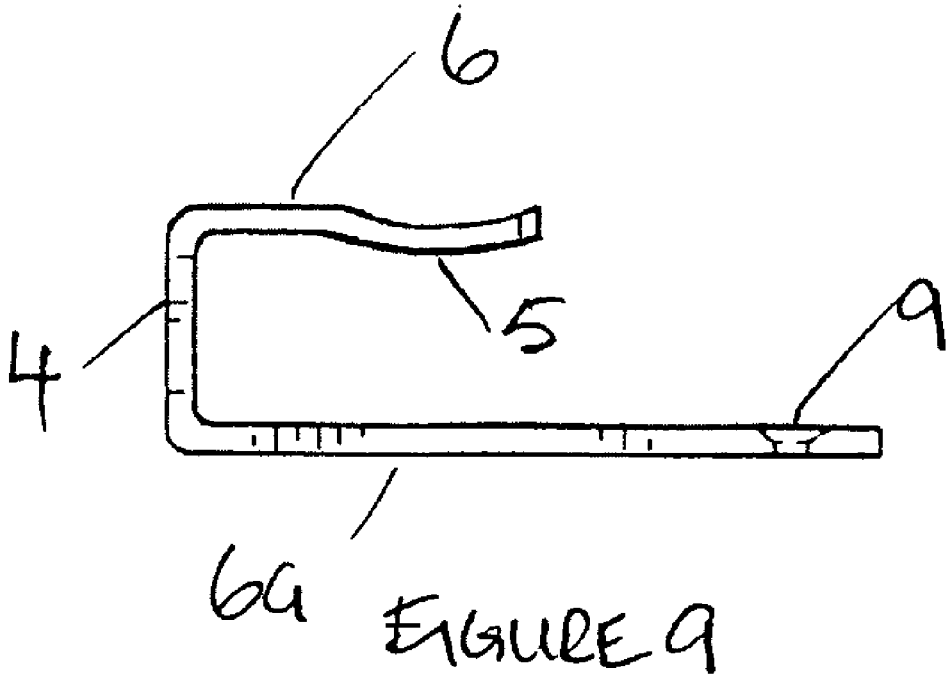
FIG. 9 is a side view of a starter clip

Referring to FIGS. 7 and 8, a starter clip 8 is provided which is functionally and dimensionally identical to clip 1 save that both the base portion 6*a* and the arm flange 6 are oriented in the same direction with reference to the vertical leg 4. This enables the starter clip vertical leg 4 to be positioned flush against a vertical surface in cases where one side of the deck abuts a wall as shown in FIG. 7.

Figure 6:
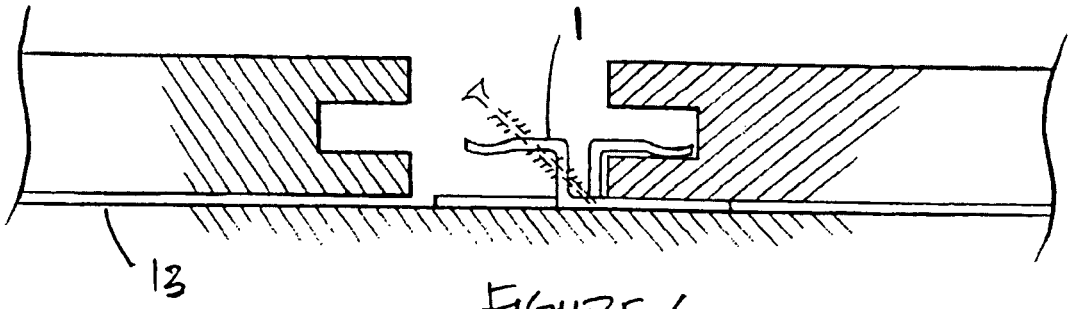
FIG. 6 is a cross sectional view of two deck members and clip at one stage of assembly

A typical deck installation method is now described with reference to a deck which abuts a vertical wall surface at one end with reference to FIGS. 6 and 7.

The decking installation commences with the installation of a row of starter clips 8 at each joist extremity which are each positioned flush with the wall with the base and arm flanges pointing inwardly from the wall. The starter clip is attached by means of fastening aperture 9 provided in the base of the clip for receiving a suitable fastener. A first grooved deck member is installed in perpendicular orientation to the joist 13 by means of sliding or pivoting the deck member into the starter clip whereby the bottom edge 12 of the grooved deck member is inserted into the U-shaped jaw of the starter clip.

The action of installing the first deck member displaces the arm flange upwardly and causes the arm flange to exert a downward force on the bottom inside surface of the groove 16. In this matter the decking member is secured to the joist. The tightness of the fit serves to eliminate any up and down motion of the installed deck member.

Figure 3:
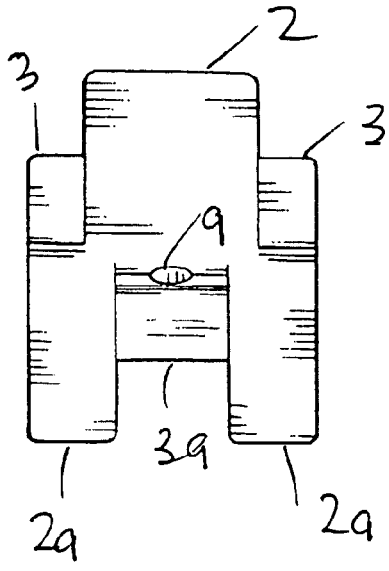
FIG. 3 is a top view of the clip according to this invention

Once the first deck member is installed, a series of regular clips 1 are installed by means of manual insertion of the clip jaw over the bottom edge 12 of the deck member. Once firmly seated, the clip is fastened to the top of the joist by any suitable means such as a screw which passes through aperture 9 provided in the base of the clip shown in FIG. 3. It is noted that the preferable location for the aperture is at the bottom of the vertical leg portion so as to be accessible once the clip is installed in the groove. This method requires the clip to be unidirectionally installed although other or multiple locations for fastening apertures on the clip can be provided to eliminate this unidirectional requirement.

Figure 10:
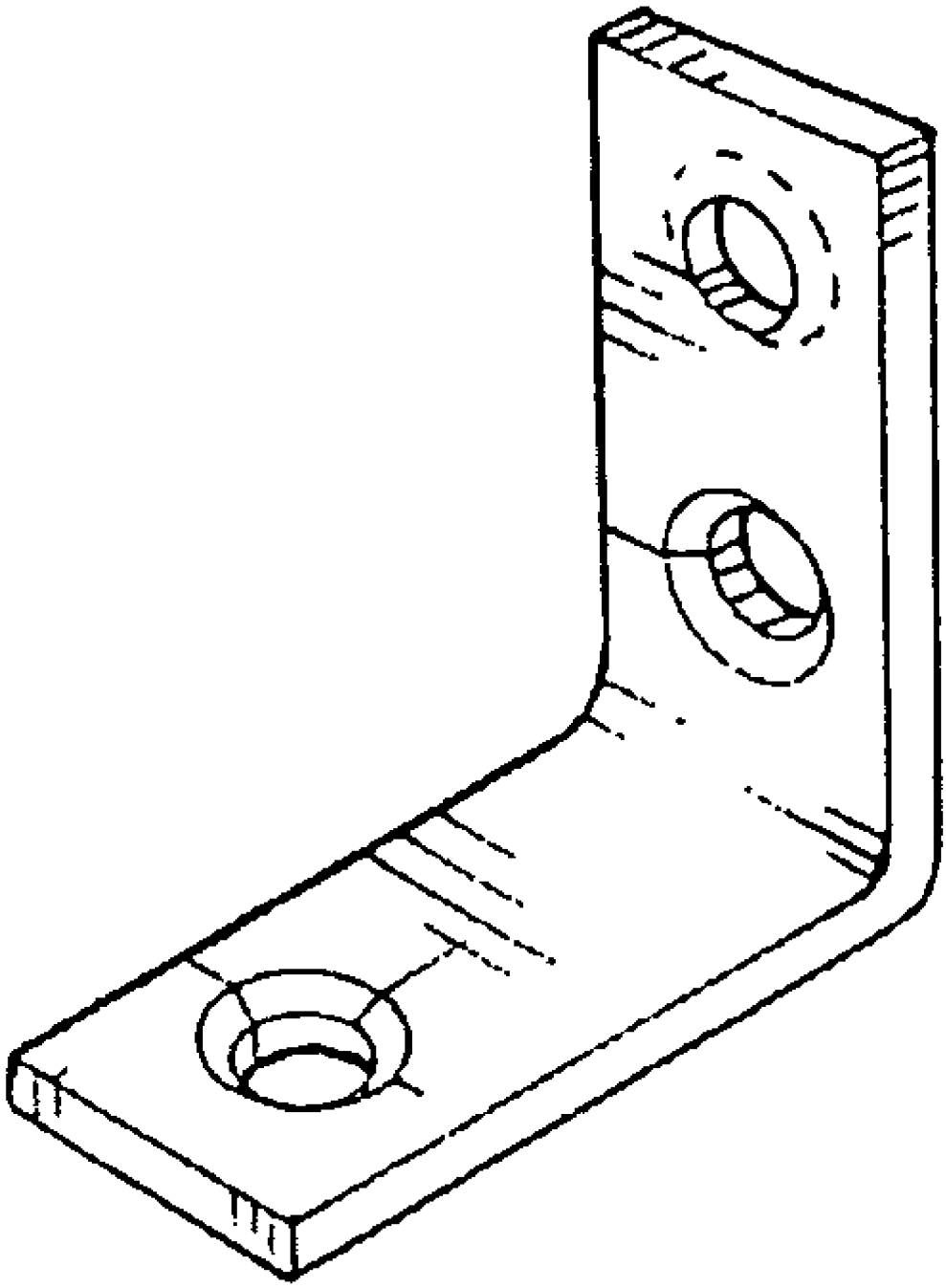
FIG. 10 is a perspective view of an angle iron

Thereafter, the deck installation process proceeds sequentially with the next decking member being inserted in like fashion to the first decking member and secured with another row of clips 1 and so forth unit the deck is finished. It is to be noted that this installation method ensures that the boards are automatically spaced from one another by reason of the offset distance S. Additionally, an angle clip shown in FIG. 10 may be used to secure the opposite or free end of the deck member in some appropriate underneath fashion. It is noted that the use of either the starter clip or angle clip are not essential to this invention since a deck installer may choose to substitute some other fastening protocol for the first or last decking member instead without detracting from the main object of this invention.

The clip is preferably manufactured from 16 gauge steel (0.62" min.) H.R.P.O. H.S.L:LA (50 KSI min.) by means of stamping.

Further advantages which are inherent to the invention are obvious to one skilled in the art. The embodiments are described herein illustratively and are not meant to limit the scope of the invention as claimed. Variations of the foregoing embodiments will be evident to a person of ordinary skill and are intended by the inventor to be encompassed by the following claims.

What is claimed is:

1. A clip device secured to a supporting structure fastening first and second structural deck members having a rectangular cross section and a longitudinal groove in each side edge defining a top and bottom edge portions, comprising:

a. a base portion with first and second opposed ends and a thickness, b. a first vertical leg portion integral with the base portion, c. a second vertical leg portions on either side of the first leg portion integral with the base portion, d. arm flange portions integral with the first and second vertical leg portions horizontally spaced from said base and aligned respectively towards said first and second opposed ends, and e. a fastener receiving means in the base portion overlying the supporting structure for receiving a fastener therethrough to attach the base portion to the supporting structure, wherein said portions define diametrically opposed first and second U-shaped jaw elements engaging and securing said edge portions of said first and second structural deck member.

2. The invention as claimed in claim 1 wherein said first vertical leg portion is horizontally spaced apart from said second vertical leg portion on said base portion between said first and second opposed ends.

3. The invention as claimed in claim 2 wherein each said jaw element is adapted to hold a bottom edge portion of each said first and second structural deck members.

4. The invention as claimed in claim 3 wherein said fastening means is a hole adapted to receive a fastener for fastening the clip device to a joist member.

5. The invention as claimed in claim 4 wherein said arm flange portions have a downward indentation for engaging the inside bottom surface of the groove.

6. As claimed in claim 5 wherein said horizontal spacing of said arm flange portions above said base portion is smaller than the thickness of said bottom edges of said structural deck members by about 0.05 inches.

* * * * *